United States Patent [19]

Isbell et al.

[11] Patent Number: 4,984,643

[45] Date of Patent: Jan. 15, 1991

[54] ANTI-BALLING EARTH BORING BIT

[75] Inventors: Matthew R. Isbell; Rudolf C. O. Pessier, both of Houston, Tex.

[73] Assignee: Hughes Tool Company, Houston, Tex.

[21] Appl. No.: 496,820

[22] Filed: Mar. 21, 1990

[51] Int. Cl.[5] ..... E21B 10/08; E21B 10/16

[52] U.S. Cl. ..... 175/341; 175/356

[58] Field of Search ..... 175/341, 355, 356, 374, 175/376, 378, 331, 339

[56] References Cited

U.S. PATENT DOCUMENTS

| | | | |
|---|---|---|---|
| 1,480,014 | 1/1924 | Scott | 175/341 |
| 1,647,753 | 11/1927 | Scott et al. | 175/341 |
| 1,983,316 | 12/1934 | Scott et al. | 175/341 |
| 2,333,746 | 11/1943 | Scott et al. | 175/376 |
| 2,774,571 | 12/1956 | Morlan | 175/341 |
| 2,804,282 | 8/1957 | Spengler, Jr. | 175/378 |
| 3,401,759 | 9/1968 | White | 175/341 |
| 3,495,668 | 2/1970 | Schumacher, Jr. | 175/341 |
| 3,762,485 | 10/1973 | Chesser et al. | 175/64 X |
| 3,946,820 | 3/1976 | Knapp | 175/341 |
| 4,187,921 | 2/1980 | Garner | 175/424 X |
| 4,516,642 | 5/1985 | Childers et al. | 175/340 |
| 4,611,673 | 9/1986 | Childers et al. | 175/340 |

OTHER PUBLICATIONS

Society of Petroleum Engineers, "Crossflow and Impact Under Jet Bits", R. H. McLean, Jul. 1964, pp. 1299–1306.

Trans. Chem. Engrs. "Entrainment in Turbulent Fluid Jets", Prof. M. B. Donald, et al, vol. 37, 1959, pp. 255–267.

*Primary Examiner*—Stephen J. Novosad

*Attorney, Agent, or Firm*—Robert A. Felsman

[57] ABSTRACT

A three cone earth boring bit having circumferential rows of earth disintegrating teeth of wear resistant inserts of selected projection from the cone surfaces, one cone having an inner row separated from a heel row by a narrow circumferential groove and second cone having a hell-catching row that intermeshes with the narrow groove by an amount to minimize balling. A nozzle directs a jet stream with a high velocity core past the cone and inserts of adjacent cutters to the bore hole bottom to break up the filter cake while the lower velocity skirt strikes the material packed between the inserts of adjacent cores. A row of small diameter, recessed reaming inserts replaces the conventional heel row on the cone having a hell-catching row, thus providing space for the lateral displacement of the material generated between adjacent inserts in the critical heel-catching row.

10 Claims, 13 Drawing Sheets

ANTI-BALLING EARTH BORING BIT

BACKGROUND OF THE INVENTION

1. Field of the Invention:

This invention relates to earth boring bits used in the oil, gas and mining industries, especially those having rolling cutters and features to prevent the cutter teeth from "balling up" with compacted cuttings from the earth.

2. Background Information:

Howard R. Hughes invented a drill bit with rolling cones used for drilling oil and gas wells, calling it a "rock bit" because it drilled from the outset with astonishing ease through the hard cap rock that overlaid the producing formation in the Spindletop Field near Beaumont, Tex. His bit was an instant success, said by some the most important invention that made rotary drilling for oil and gas commerically feasible the world over (U.S. Pat. No. 930,759, "Drill", Aug. 10, 1909). More than any other, this invention transformed the economies of Texas and the United States into energy producing giants. But the invention was not perfect.

Mr. Hughes' bit demolished rock with impressive speed, but it struggled in the soft formations such as the shales around Beaumont, Texas, and in the Gulf Coast of the United States. Shale cuttings sometimes compacted between the teeth of the "Hughes" bit, until it could no longer penetrate the earth. When pulled to the surface, the bit was often, as the drillers said, "balled up" with shale—sometimes until the cutters could no longer turn. Even moderate balling up slowed the drilling rate and caused generations of concern within Hughes' and competitive engineering organizations.

Creative and laborious efforts ensued for decades to solve the problem of bits "balling-up" in the softer formations, as reflected in the prior art patents. Impressive improvements resulted, including a bit with interfitting or intermeshing teeth in which circumferential rows of teeth on one cutter rotate through opposed circumferential grooves, and between rows of teeth, on another cutter. It provided open space on both sides of the inner row teeth and on the inside of the heel teeth. Material generated between adjacent teeth in the same row was displaced into the open grooves, which were cleaned by the intermeshing rows of teeth. It was said, and demonstrated during drilling, " . . . the teeth will act to clear each other of adhering material." (Scott, U. S. Pat. No. 1,480,014, "Self-Cleaning Roller Drill", Jan. 8, 1924.) This invention led to a two cone bit made by " . . . cutting the teeth in circumferential rows spaced widely apart . . ." This bit included" . . . a series of long sharp chisels which do not dull for long periods." The cutters were true rolling cones with intermeshing rows of teeth, and one cutter lacked a heel row. The self cleaning effect of intermeshing thus extended across the entire bit, a feature that would resist the tendency of the cutters becoming balled-up between rows of teeth in soft formations. (Scott, U.S. Pat. No. 1,647,753, "Drill Cutter", Nov. 1, 1927.)

Interfitting teeth were shown for the first time on a three cone bit in U.S. Pat. No. 1,983,316. The most significant improvement being the width of the grooves between teeth, which were twice as wide as those on the two cone stucture without increasing uncut bottom. This design also combines narrow interfitting inner row teeth with wide non-interfitting heel rows.

A further improvement in the design is shown in U.S. Pat. No. 2,333,746, in which the widest heel teeth were partially delected, a feature that decreased balling and enhanced penetration rate. A refinement of the design was the replacement of the narrow inner row teeth with fewer rows of wider teeth, which again improved performance in shale drilling.

By now the basic design of the three cone bit was set: (1) All cones had intermeshing inner rows, (2) the first cone had a heel row and a wide space or groove equivalent to the width of two rows between it and the first inner row with intermeshing teeth to keep it clean, (3) a second cone had a heel row and a narrow space or groove equivalent to the width of a single row between it and the first inner row without intermeshing teeth, and (4) a third cone had a heel and first inner row in a closely spaced, staggered arrangement. A shortcoming of this design is the fact that it still leaves the most critical outer portion of the cutting structure subject to balling.

Another technique of cleaning the teeth of cuttings involved flushing drilling fluid or mud directly against the cutters and teeth from nozzles in the bit body. Attention focused on the best arrangement of nozzles and the direction of impingement of fluid against the teeth. Here, divergent views appeared, one inventor wanting fluid from the nozzles to " . . . discharge in a direction approximately parallel with the taper of the cone" (Sherman, U.S. Pat. No. 2,104,823, "Cutter Flushing Device", Jan. 11, 1938), while another wanted drilling fluid discharged ". . . approximately perpendicular to the base [heel] teeth of the cutter." (Payne, U.S. Pat. No. 2,192,693, "Wash Pipe", Mar. 5, 1940.)

A development concluded after World War II seemed for a while to solve the old and recurrent problem of bit balling. A research effort of Humble Oil and Refining Company resulted in the "jet" bit. This bit was designed for use with high pressure pumps and bits with nozzles that pointed high velocity drilling fluid directly against the borehole bottom, with energy seemingly sufficient to quickly disperse shale cuttings, and simultaneously, keep the cutters from balling up because of the resulting turbulent flow. This development not only contributed to the reduction of bit balling, but also addressed another important phenomenon which became later known as chip holddown.

From almost the beginning, Hughes and his engineers recognized variances between the drilling phenomena experienced under atmospheric condition and those encountered deep in the earth. Rock at the bottom of a liquid-filled borehole is much more difficult to drill than the same rock brought to the surface of the earth. Model sized drilling simulators showed in the 1950's that removal of cuttings from the borehole bottom is impeded by the filter cake resulting from the use of drilling mud. ("Laboratory Study of Effect of Overburden, Formation and Mud Column Pressures on Drilling Rate of Permeable Formations", by R. A. Cunningham and J. G. Eenick, Journal of Petroleum Technology, Jan. 1959). A thin layer of this filter cake is benefical to seal and stabilize the borehole. But if there is a large difference between the borehole and formation pressure, also known as overbalance or differential pressure, this layer of filter cake sometimes increases in thickness with the addition of cuttings from the bottom and forms a strong mash layer, which keeps the cutter teeth from reaching virgin rock. The problem is accentuated in deeper holes. One approach to overcome this perplexing problem is the use of ever higher jet velocities in an attempt to blast through the filter cake and dislodge cuttings so they may be flushed through the well bore to the surface.

The filter cake problem and the balling up problem are distinct since filter cake build-up occurs mostly in permeable formations such as sand, and balling is typically seen when drilling impermeable shales. Yet, these problems can overlap in the same well since both formations have to be drilled by the same bit. Inventors have not always made clear which of these problems they are addressing, at least not in their patents. However, a successful jet arrangement must deal with both problems; it must clean the cones but also impinge on bottom to overcome chip holddown.

The direction of the jet stream and the area of impact on the cutters and borehole bottom receives periodic attention of inventors. Some interesting, if unsuccessful, approaches are disclosed in the patents. One patent provides a bit that discharges a tangential jet that sweeps into the bottom corner of the hole, follows a radial jet, and includes an upwardly directed jet to better sweep cuttings up the borehole. (Williams, Jr., U.S. Pat. No. 3,144,087, "Drill Bit With Tangential Jet", Aug. 11, 1964.) The cutters have unusual cutter arrangement, including one with no heel row of teeth, and two of the cutters do not engage the wall of the borehole. One nozzle extends through the center of the cutter and bearing shaft and another exits at the bottom of the "arm" (also sometimes called incongruently the "leg" of the bit body) near the corner of the borehole.

There is some advantage to placing the nozzles as close as possible to the bottom of the borehole. (Feenstra, U.S. Pat. No. 3,363,706, "Bit With Extended Jet Nozzles", Jan. 16, 1968.) The prior art also shows examples of efforts to orient the jet stream from the nozzles such that they partially or tangentially strike the cutters and then the borehole bottom at an angle ahead of the cutters. (Childers, et al, U.S. Pat. No. 4,516,642, "Drill Bit Having Angled Nozzles For Improved Bit and Well Bore Cleaning", May 14, 1985.)

In spite of the extensive efforts of inventors laboring in the rock bit art since 1909, including those of the earliest, Howard R. Hughes, the ancient problem of rock bits "balling up" persists. The solutions of the past have reduced balling in many drilling environments, and the bit that balls up so badly that the cutters will no longer turn is a species of the problem that has all but completely disappeared. Now, the problem is confined to only part of the rock bit and often escapes detection. It is more subtle and disguised by other events in the drilling process and largely unappreciated as a cause of poor drilling performance. However, it is present and can reduce penetration rates to one-half in typical shale drilling. It gains added importance in view of conservative estimates that more than one-half of all drilling takes place in ductile and balling shales.

SUMMARY OF THE INVENTION

It is therefore the general object of the invention to improve the earth boring bit by reducing balling between the heel and inner rows.

Accordingly, the improvement is a three-cone earth boring bit having circumferential rows of earth disintegrating teeth of wear resistant inserts of selected projection from the cone surfaces, one cone having an inner row separated from a heel row by a narrow circumferential groove and a second cone having a hell-catching row that intermeshes with the narrow groove by an amount to minimize balling.

In the preferred embodiment, the oblique angle of the shafts, the geometry of the cones and the sizes of the inserts are selected such that every circumferential groove between rows on a cone intermeshes with a row of inserts of an adjacent cone, including the narrow groove that is only the equivalent of one row width wide. In one embodiment one cone has no conventional heel row but a row of reaming inserts.

The nozzles of the bit direct each jet stream between the cones such that the lower velocity fluid between the outer boundary and the core of the jet passes between the inserts of the heel and adjacent rows while the high velocity cylindrical core misses the inserts and strikes the borehole bottom.

Additional objects, features and advantages of the invention will become apparent in the following description.

DESCRIPTION OF THE PREFERRED EMBODIMENTS

Figure 1:
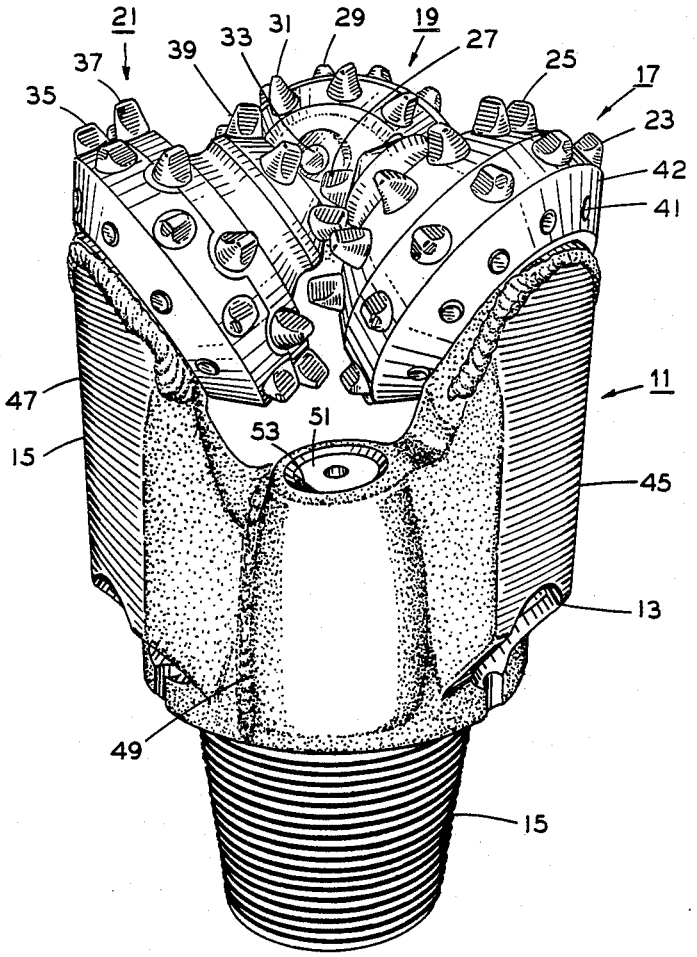
Fig. 1 PRIOR ART
FIG. 1 is a perspective view of a prior art earth boring bit of the type having sintered tungsten carbide inserts used as earth disintegrating teeth in cones rotatably secured to bearing shafts. This particular bit is a "Hughes" JO5.

The numeral 11 in FIG. 1 of the drawing designates a prior art "Hughes" JO5 earth boring bit of the type having three rotatable cutters, each having wear resistant inserts used as earth disintegrating teeth.

A bit body 13 has an upper end which is threaded at 15 to be secured to a drill string member (not shown) used to raise and lower the bit in a wellbore and to rotate the bit during drilling. This particular bit has three cones designated by the numerals 17, 19 and 21.

The inserts that form the earth disintegrating teeth in bit 11 are arranged in circumferential rows, here designated by the numerals 23, 25 and 27 on cone 17; by the numerals 29, 31 and 33 on cone 19; and by the numerals 35, 37 and 39 on cone 21. Additional inserts, called "gage" inserts 41 are shown protruding from a gage surface 42 on each cone, such as cone 17.

Figure 2:
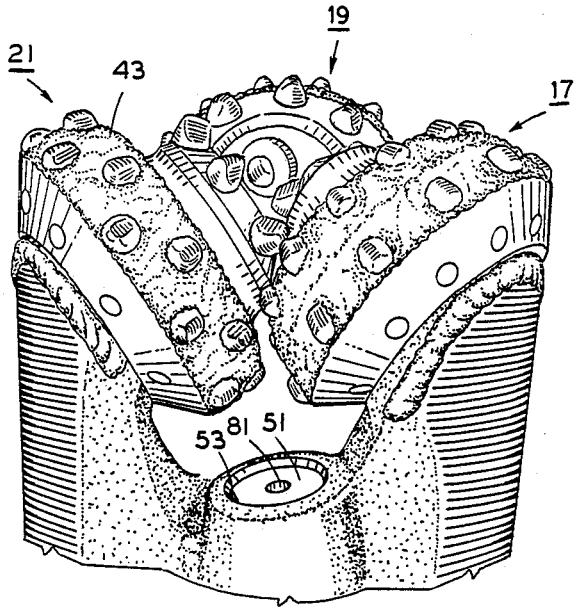
Fig. 2 PRIOR ART
FIG. 2 is a perspective view of the prior art bit shown in FIG. 1 after having been run in a formation that caused some of the teeth to ball-up.
Figure 4:
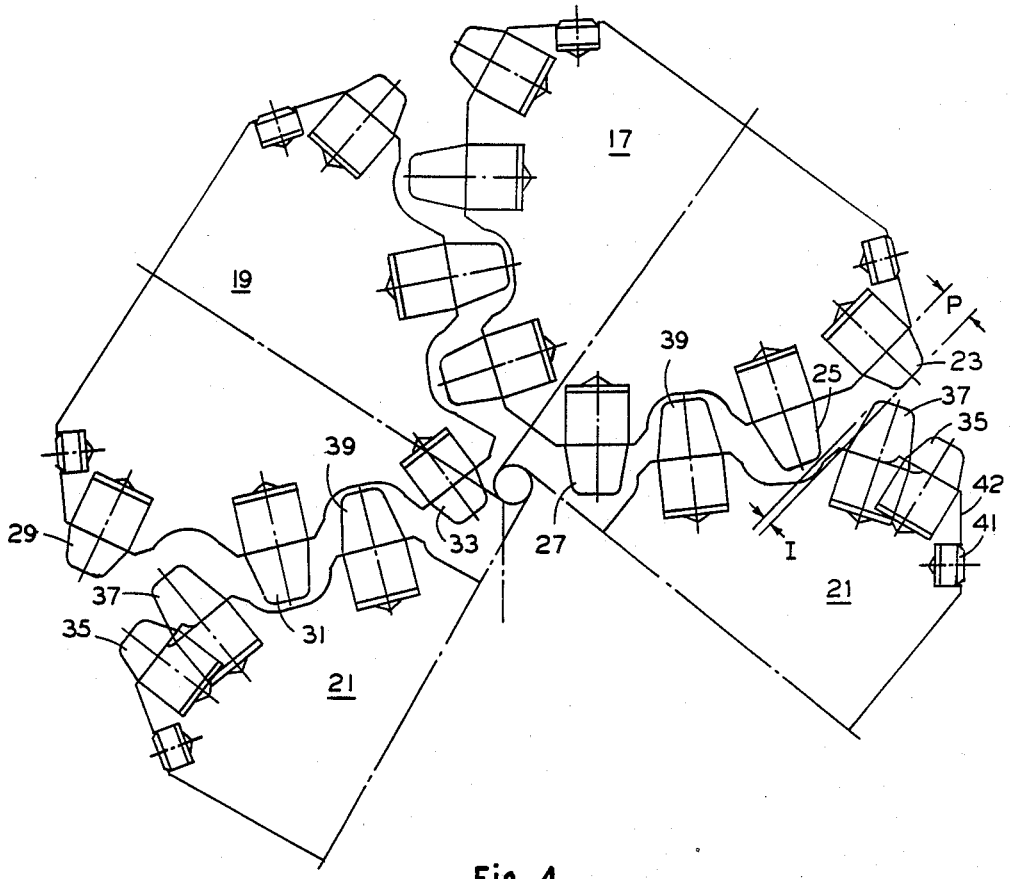
Fig. 4 PRIOR ART
FIG. 4 is a design layout of the cones of the prior art bit of FIG. 1 to show the relationship between the cones and the circumferential rows of inserts.

The circumferential rows of inserts 23, 29 and 35 are known as "heel row" inserts that disintegrate formation at the outermost region adjacent the wall of the hole. Typically, there is one cone 21, as shown in FIG. 1, in which there is one row 37 that is very closely spaced to a heel row 35. This row 37 is known by various names in the industry, such as the "hell-catching row" or the "adjacent heel row." The inserts of row 37 are widely spaced as are the inserts in heel row 35. The word "spacing" refers here to the distance between adjacent inserts in a row, but sometimes also refers to the distance between adjacent rows. The wide spacing of the inserts in row 37 results from this row being closely spaced and staggered with respect to heel row 35. Here, rows 37 and 35 overlap in a radial plane perpendicular to the rotational axis of the cone. The low density of the inserts in row 37 causes disproportionate unit loading as the inserts traverse the bottom of the borehole. This row is also the first row inside the heel rows that provides single row coverage of the borehole bottom. As a result, this row is the most heavily worked, giving rise to the designation of "hell-catching row." The close relationship and spacing between inserts 37 and 35 of cone 21 also causes these inserts to experience more severe "balling" of cuttings than inserts in other rows. Balling occurs since the close axial and staggered spacing of inserts in adjacent rows 37, 35, with no open space or groove between them, impedes lateral displacement of the drilled up material and enables a continuing build-up of cuttings, making the heel and the hell-catching rows the first and most likely to ball up as shown on cone 21 of FIG. 2. As penetration rate increases and more cuttings are generated, cone 17 begins to ball. Cone 17 as shown in FIG. 1 has only a narrow groove between the heel row 23 and first inner row 25, with only marginal intermesh I from the insert 37 of the adjacent cone. As shown in FIG. 4, row 37 extends into the groove between inserts 23, 25 only a marginal distance I of about about 20 percent as compared to the projection P that the end of insert 23 extends from the surface of cone 17. Material displaced into the narrow groove is therefore not removed by the intermeshing rows of inserts and thus balls up as shown in FIG. 2. At the highest penetration rates, even the single heel of cone 19 of FIG. 1 balls up as shown in FIG. 2.

Balling impedes the progress of the bit during drilling by preventing the teeth or inserts from effectively penetrating the earth. When a bit reaches the condition shown in FIG. 2, the rate of penetration (ROP) falls by as much as fifty percent.

The prior art bit 11 of FIG. 1 is composed of sections 45, 47 (and another not shown) that are welded as at 49. Although not shown in FIG. 1, the interior of the bit body is hollow to contain fluid directed into three passages, one each of which supplies a nozzle 51. Typically, the nozzle 51 is formed of a wear resistant material such as sintered tungsten carbide retained in a receiving drilled hole with a snap ring 53.

Figure 3:
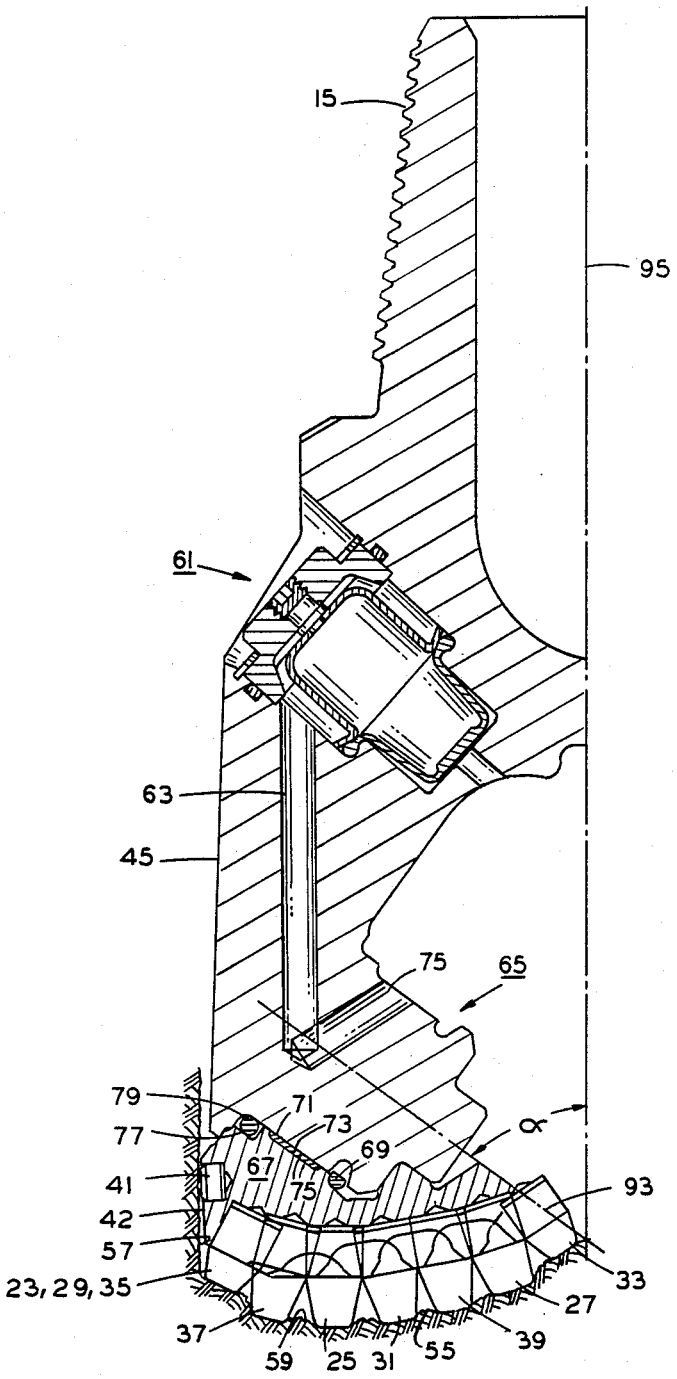
Fig. 3 PRIOR ART
FIG. 3 is a fragmentary longitudinal section of the prior art bit of FIG. 1, the drawing being schematic in showing all of the inserts of all of the cones rotated into a position to show their relationship to each other and to the borehole bottom.

FIG. 3 is a longitudinal section of the prior art bit of FIGS. 1 and 2, the drawing being schematic in showing all rows of inserts of all the cones rotated into a position to show the relationship to each other and to the borehole bottom 55. As is typical in a three cone rock bit, there are areas of uncut bottom such as that indicated by the numeral 59. Here, the rows of inserts have been numbered to correspond with the numbering in FIG. 1 to show the relationship between the various rows of inserts and the borehole bottom.

FIG. 4 is a design layout of the cones of FIGS. 1 and 2 to show the relationship between the cones and the circumferential inserts. The rows of inserts are numbered to correspond to FIGS. 1 and 3.

FIG. 3 also shows a fragmentary cross section of one section 45 of the bit 11 including the threaded upper end 15, and an intermediate region which contains the pressure compensating and lubrication system 61, which may be of the type shown in U.S. Pat. No. 4,727,942. The lubrication system includes passages 63 by which lubrication is introduced between the spaces of a bearing shaft 65 and the associated cutter shell 67. Each cone is retained on its associated bearing shaft 65 by means of a retaining ring 69. Each cone typically has a cylindrical bearing surface 71 with a soft metal inlay 73 that opposes and engages a cylindrical journal bearing surface 75 on the shaft 65. Each cutter has a seal groove 77 and suitable seal such as the O-ring 79 to retain lubricant within the bearing system.

Figure 5:
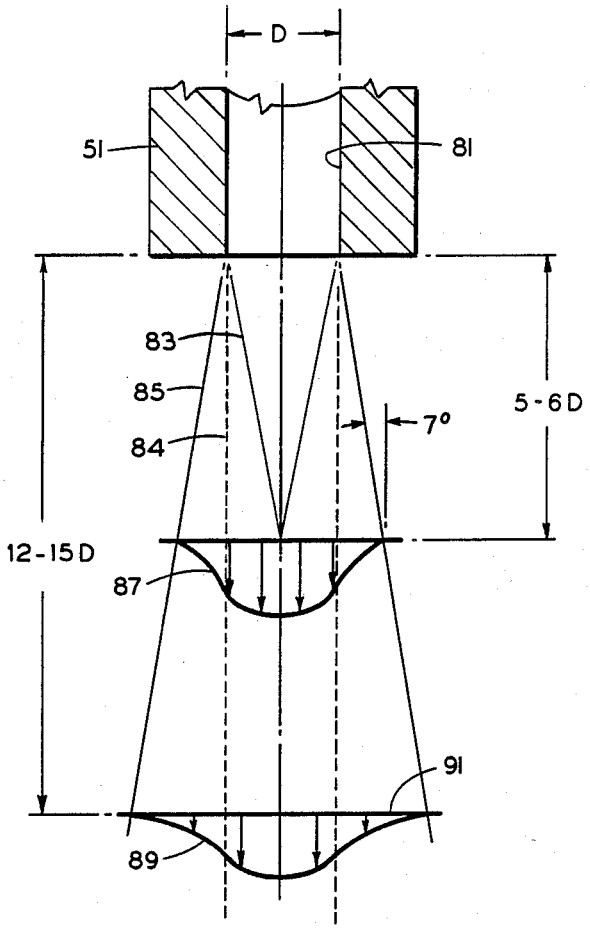
Fig. 5 PRIOR ART
FIG. 5 is a longitudinal and schematic view of a jet or nozzle used in an earth boring bit, showing the manner in which the fluid exits the nozzle in a core and a diverging skirt.

Each of the typical prior art bits such as that shown in FIGS. 1–4 has in each of its three nozzles 51 (see FIG. 2) an orifice 81 of selected diameter. Fluid is pumped from the surface, through the drill pipe (not shown) and through the three nozzles 51 of the bit. Fluid exits the nozzle at a high velocity and entrains and accelerates the surrounding fluid at its boundary or skirt 85, as shown in FIG. 5. As more fluid is entrained with increasing distance from the nozzle exit, the jet diameter increases to define the boundary 85. The angle of spread is typically 7 degrees. At each distance from the end of the nozzle 51 there is a characteristic velocity profile. Two such profiles are indicated by the numerals 87 and 89. The bottom of the hole 91 is illustrated schematically and is usually a distance of approximately 12 to 15 nozzle diameters from the nozzle exit for bits of the type shown in FIGS. 1–4. The jet passes through the tightest spot between the cones approximately six nozzle diameters from the nozzle exit. Inside the boundary 85 of the jet is a converging conical region 83 in which the jet velocity is equal to the nozzle exit velocity. As indicated in FIG. 5, the jet stream is divided into three regions: (1) the low velocity outer region, boundary or skirt 85, (2) the high velocity, generally cylindrical core 84 where the velocity is substantially higher than at the boundary 85, as indicated in the velocity profiles, and (3) the highest velocity conical region 83.

Returning to FIG. 3, the axis 93 of the bearing shaft 65 is obliquely oriented with respect to the central or rotational axis 95 of drill bit, as indicated by the angle alpha. The angle alpha is referred to as the pin angle.

Figure 6:
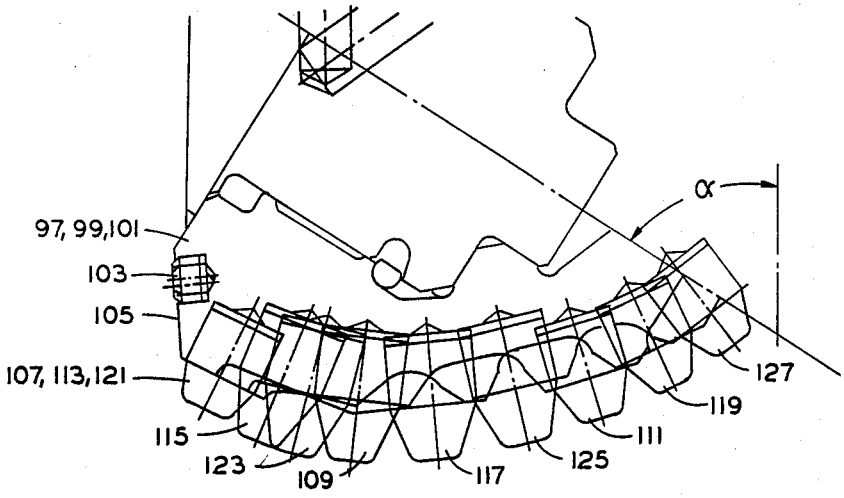
Fig. 6 PRIOR ART
FIG. 6 is a longitudinal section of a prior art "Hughes" J22, the drawing being schematic in showing all of the inserts of all the cones rotated into a position to show their relationship to each other and to the borehole bottom.

FIG. 6 is a prior art bit known as a "Hughes" J22 in fragmentary side elevation, which is schematic in showing all of the inserts of all of the cones rotated into a position to show their relationship to each other and to the bottom of the borehole during drilling. This bit has a drill bit body lubrication and bearing system similar to that shown and described in connection with FIG. 3. For this reason, these components of the bit will not be described. However, the arrangement of the rows of teeth is different from that shown in FIG. 3, and corresponds with the arrangement shown in FIG. 7, which is a design layout of the cones and teeth of FIG. 6 to show the relationship between the cones and the circumferential rows of inserts.

Figure 7:
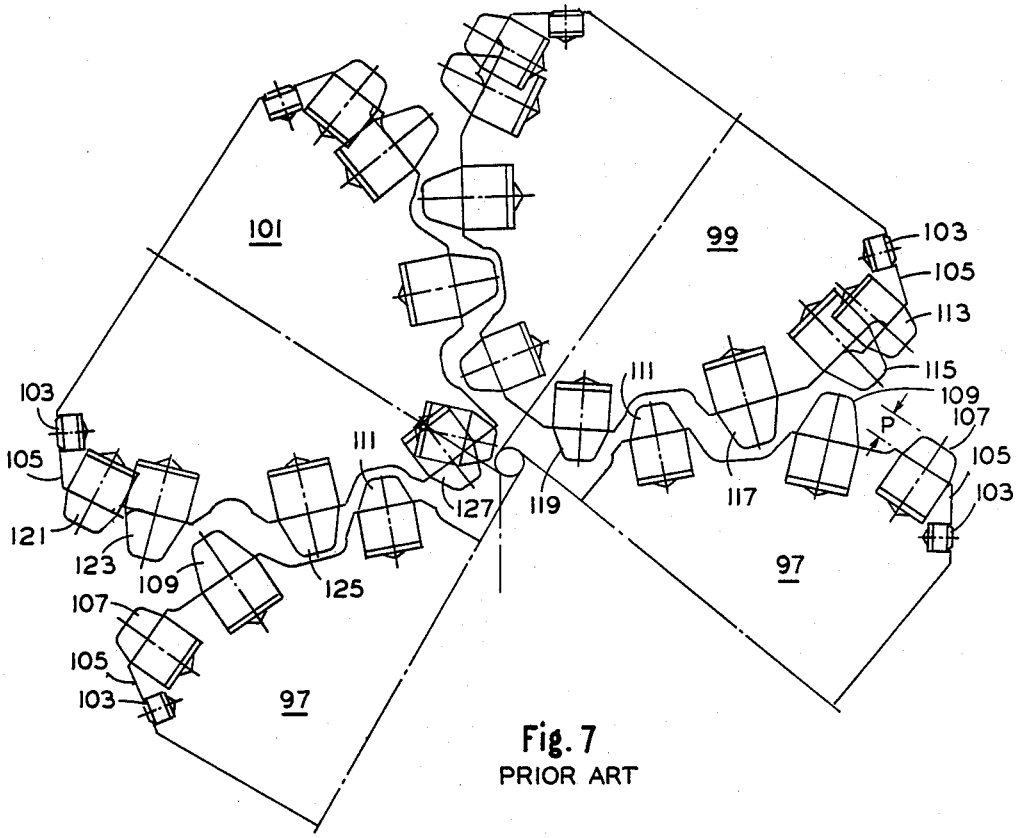
Fig. 7 PRIOR ART
FIG. 7 is a design layout of the cones of the prior art bit of FIG. 6 to show the relationship between the cones and the circumferential rows of inserts.
Figure 8:
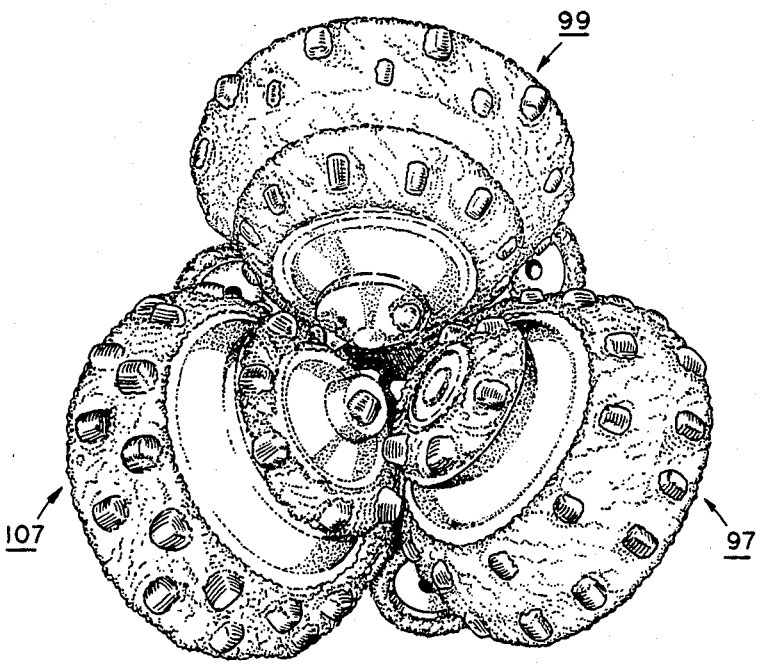
Fig. 8 PRIOR ART
FIG. 8 is a perspective view of the bit of FIG. 6 in a "balled" or "balled up" condition after drilling through a soft formation such as a shale.

The prior art bit of FIGS. 6 and 7 has three cones which are designated respectively 97, 99 and 101. Each of the cones has gage inserts 103 inserted in a gage surface 105. Cone 97 has rows of inserts 107, 109 and 111. Cone 99 has rows of inserts 113, 115, 117 and 119. Cone 101 has rows of inserts 121, 123, 125 and 127. The "Hughes" J22 of FIGS. 6 and 7 has two overlapping hell-catching rows 115, 123 to overcome the lack of durability of a single hell-catching row in harder, brittle formations. However, since the staggered hell-catching row and heel are the most likely to ball, the balling condition is aggravated in ductile shales, now occurring on two cones instead of one. Also, the lack of intermesh between row 107 and 109 and only a small degree of intermesh between rows 115 and 117 produce additional balling at high penetration rates. The balled-up condition of the J22 is shown in FIG. 8. Under controlled conditions in the laboratory, it was shown that the balled-up J22 drills about 40 percent slower than the J05 shown in FIG. 2.

Figure 9:
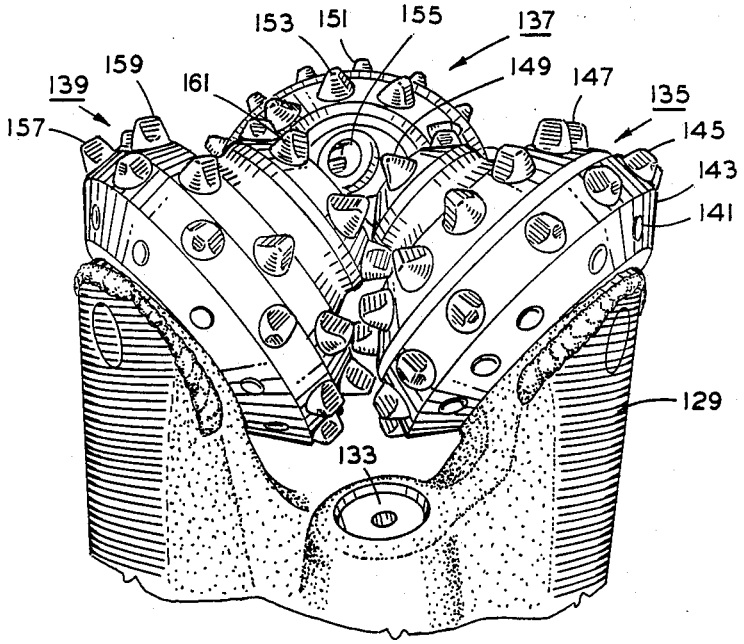
FIG. 9 is a perspective view of a bit which embodies features of the invention.

FIG. 9 is a perspective view of a drill bit which embodies features of the invention. It has nozzles 133 to direct drilling fluid toward the cones and the bottom of the borehole. This bit has three cones designated by the numerals 135, 137 and 139. Cone 135, in common with the other cones has gage inserts 141 in a gage surface 143. Also, cone 135 has rows of inserts 145, 147 and 149. Cone 137 has rows of inserts 151, 153 and 155. Cone 139 has rows of inserts 157, 159 and 161.

A simple measure of the degree of balling is obtained by taking the ratio of balled-up rows to the total number of rows expressed in percent. In computing this value, the open spaces or grooves are counted as row equivalents. Values for the "Hughes" J05 bit range from 14 to 50 percent for the individual cones and the average for the entire bit is about ⅓ or 33 percent. For the J22, the values are 25 to 57 percent for the individual cones and 44 percent for the entire bit.

This embodiment of the invention takes the basic J05 structure with the following additional feature to further reduce balling: Intermesh is provided between the hell-catching row 159 on cone 139 with the narrow space or groove between the heel row 145 and inner row 147 on cone 135. This will reduce balling from 50 to 16 percent on cone 135 and the overall balling from 33 to 22 percent as can be seen by comparing FIG. 10 with FIG. 2.

Figure 10:
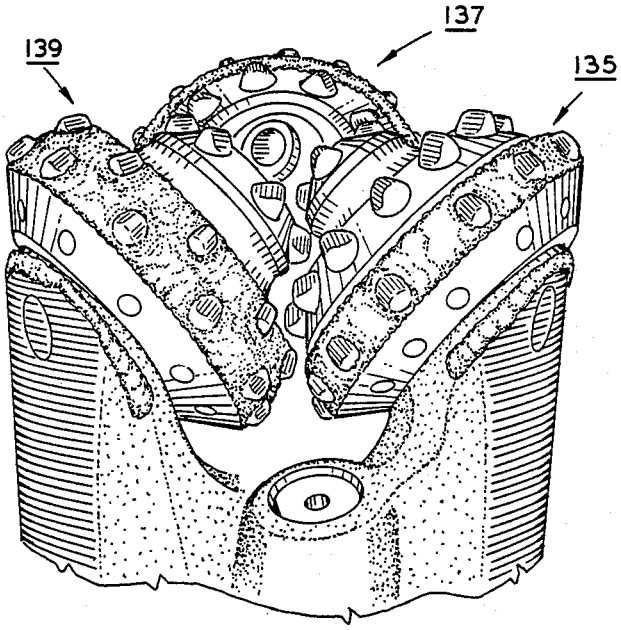
FIG. 10 is a perspective view of the bit of FIG. 9 as seen after drilling a soft formation.
Figure 11:
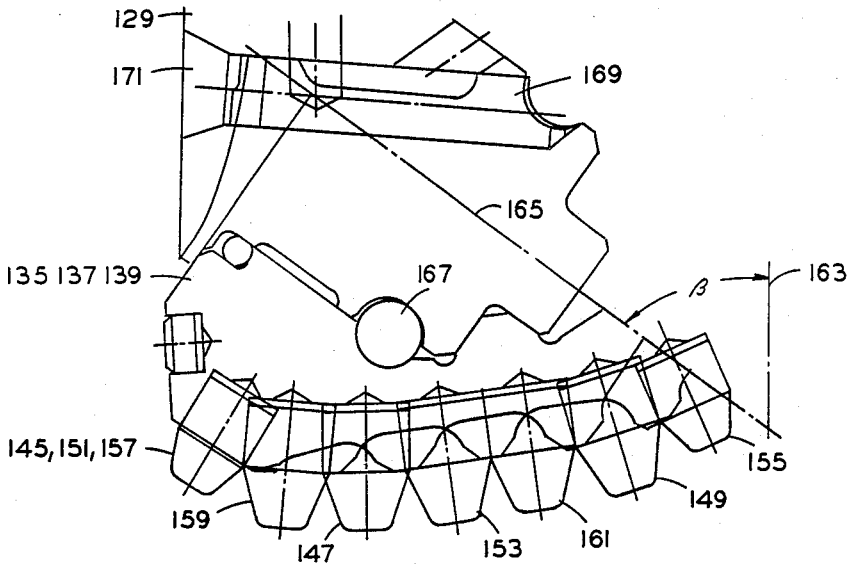
FIG. 11 is a longitudinal section of the bit of FIG. 9, the drawing being schematic in showing all of the inserts of all of the cones rotated into a position to show their relationship to each other and to the borehole bottom.
Figure 12:
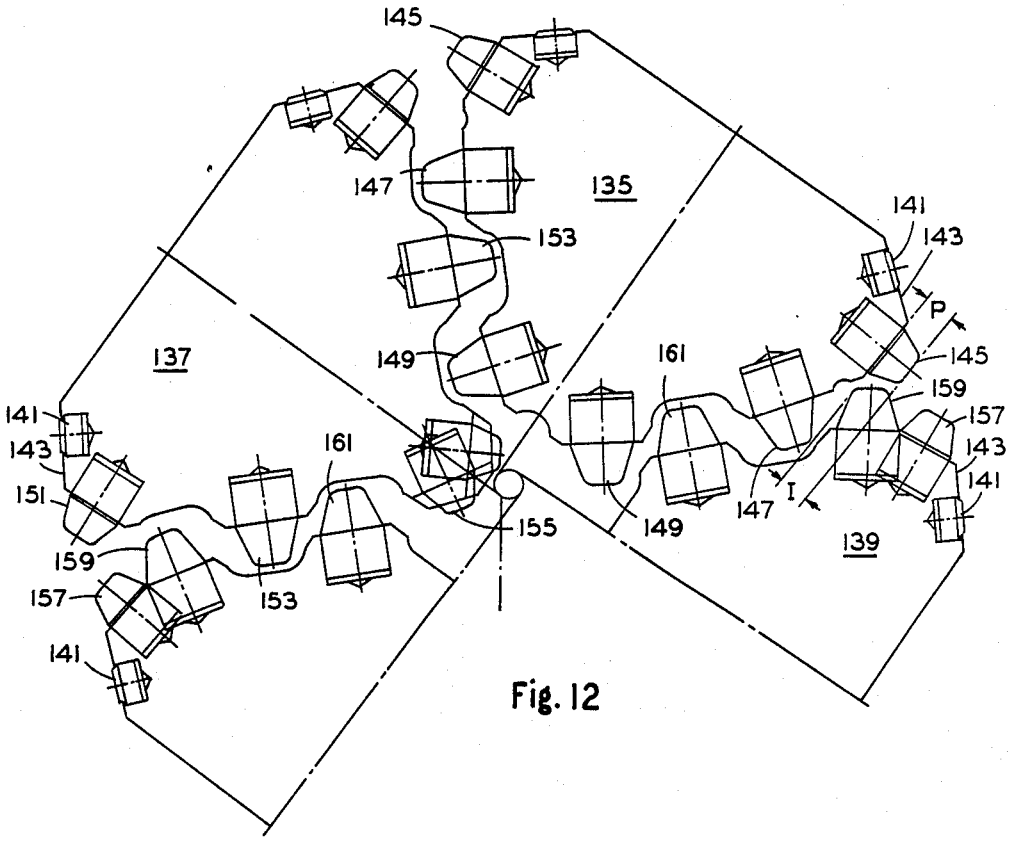
FIG. 12 is a design layout of the cones of the bit of FIG. 9 to show the relationship between the cones and the circumferential rows of inserts.

The various rows of inserts in the bit of FIG. 9 are shown in the side elevational and schematic view of FIG. 11, as well as the design layout view of FIG. 12. With reference to FIG. 12, each of the adjacent rows of inserts intermeshes or interfits with the circumferential grooves of the adjacent cones such that every circumferential groove intermeshes with a row of inserts of an adjacent cone. This is true for every set of adjacent rows, including rows 145 and 147 of cone 135. Here, inserts 159 of cutter 139 intermesh between rows 145 and 147 at a distance I which is equal to substantially the full projection P of the associated heel row 145. This is to be distinguished from the prior art bit shown in FIGS. 4 and 7. In FIG. 4 there is only marginal intermesh between the insert 37 of cone 21 between the adjacent rows of inserts 23, 25 of cone 17. In FIG. 7 there is no intermesh between the adjacent rows 107, 109 of cone 97 by the insert 115 of cone 99. This feature of the bit of FIGS. 9–12 assures a minimal amount of balling of shale or other soft formation between the rows of inserts all the way from the center to the heel rows of the bit.

With respect to FIG. 11, the center line 163 of the bit intersects the rotational axis 165 of the cutters at an oblique or pin angle beta. The angle beta is larger than the angle alpha associated with the prior art bits of FIGS. 3 and 6, which normally have an angle alpha of about 33 degrees, whereas angle beta is 36 degrees. This brings the bases of the cones closer together than that of the prior art bits. The oblique or pin angle of each of the bearing shafts, the geometry of the cones and the sizes of the inserts are selected to provide intermesh of the rows of inserts all the way from the innermost row to the heel row.

FIG. 10 shows the condition of the bit of FIG. 9 after drilling in soft formation. As is evident by comparisons with the prior art bits of FIGS. 2 and 8, there is a substantial reduction of balling on cone 135.

Figure 13:
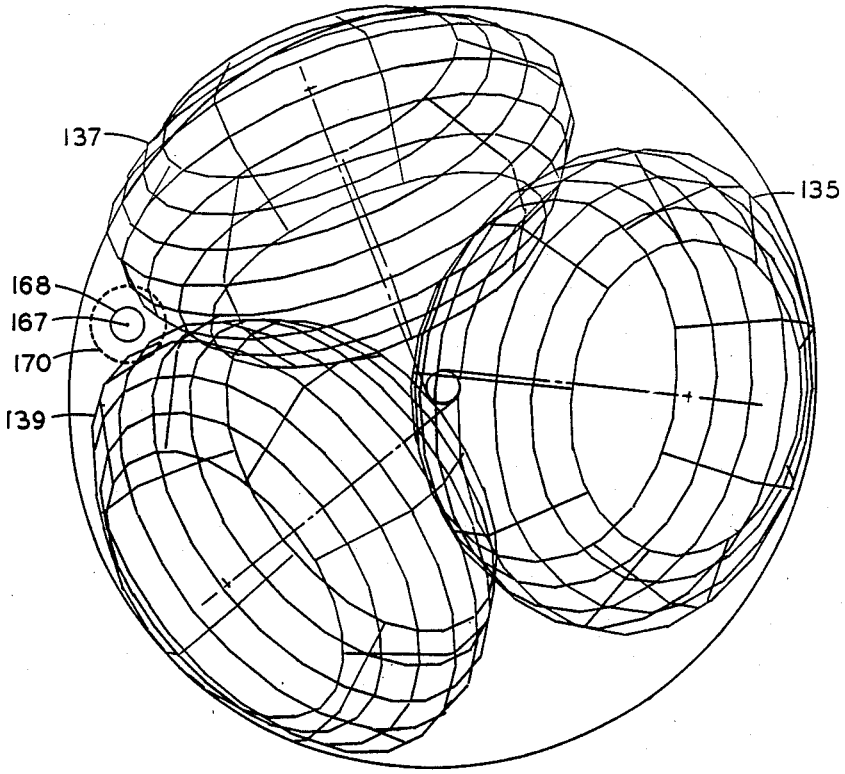
FIG. 13 is a schematic representation made by computer modeling of portions of the cones of the bit of FIG. 9 as seen looking down the axis of one of the jets.

FIG. 13 shows schematically and by computer modeling a view of the cones 135, 137 and 139 as seen looking directly down the axis 167 of the jet or nozzle of the bit. The placement of the nozzle is such that the cylindrical core 168 of the jet is positioned to miss the cutters 137, 139. This is true for the relationship between each of the nozzles and each of the adjacent cutters. This causes the high velocity core 168 of the jet to pass midway between the cones and strike the borehole bottom, while the lower velocity outer region of skirt 170 strikes the inserts of the heel and first inner rows to help clean them of cuttings lodged between inserts and reduce balling. The high velocity core remains undistrubed, directly strikes the borehole bottom and helps overcome chip holddown. The lower velocity skirt reduces balling but does not erode the cones because of its lower velocity.

FIG. 11 has a different bearing configuration from that shown in the previously described prior art bits, but these changes are not significant to the performance of the invention. In FIG. 11 a row of ball bearings 167 is used to retain the cones 135, 137 and 139 instead of a resilient snap ring as shown in FIGS. 3 and 6. The ball bearings 167 are retained on the bearing shaft by a ball plug 169 welded at 171 to the section 129 of the bit. Otherwise, the body, sections and lubrication systems of the bit of FIG. 11 are similar with those shown in FIGS. 3 and 6.

Figure 14:
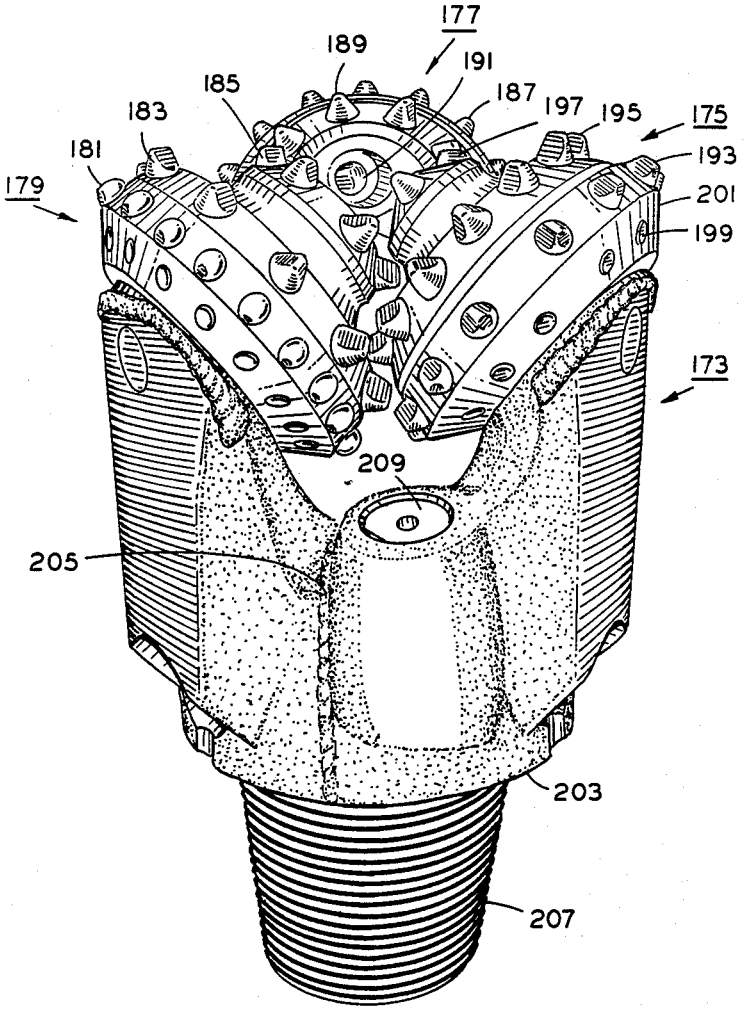
FIG. 14 is a perspective view of an alternate embodiment of the invention.

FIG. 14 illustrates a bit 173 which is another embodiment of the invention. This bit has three cones 175, 177 and 179. Cone 179 has a circumferential row of heel inserts 181, an adjacent or hell-catching row 183 and an inner row 185. Cone 177 has a heel row 187 and two inner rows 189 and 191. Cone 175 has a heel row 193 and two inner rows 195, 197. Each of the cones has a row of gage inserts 199 in gage surfaces 201. The cones are rotatably supported on a bit body 203 composed of sections welded as at 205 to form an integral body which is threaded at 207 on its upper end for connection to a drill string (not shown). Each section contains a nozzle 209 that directs fluid during drilling from an internal cavity (not shown) in the bit against the bottom of the borehole and across the teeth in selected rows.

The most distinguishing feature of the FIG. 14 bit is the small inserts 181 in cone 179. These inserts are not conventional heel inserts but rather serve as reaming inserts.

Figure 16:
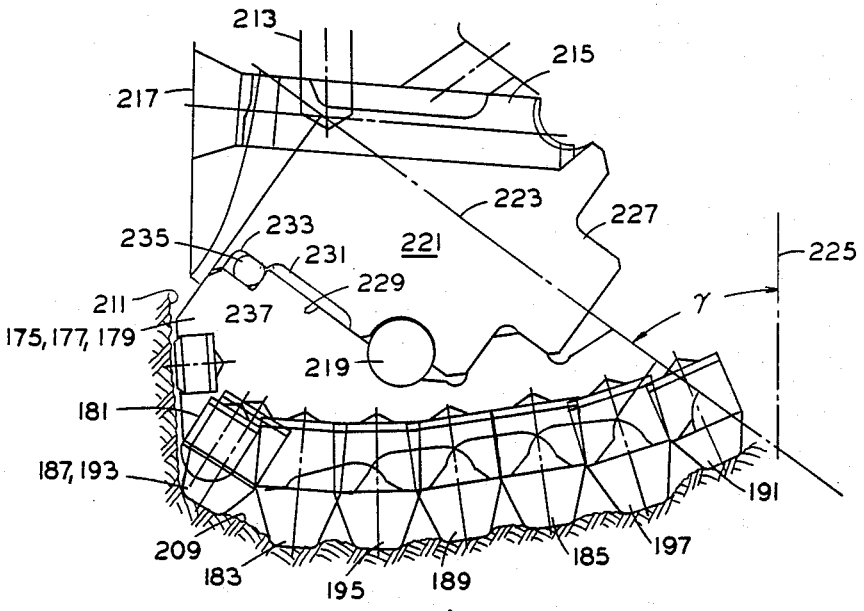
FIG. 16 is a longitudinal section of the bit of FIG. 14, the drawing being schematic in showing all of the inserts of all the cones rotated into a position to show their relationship to each other and to the borehole bottom.

FIG. 16 is a side elevation view of portions of the bit of FIG. 14, with all rows of inserts at each cutter rotated into the plane of the paper to show their relationship to the bottom of the borehole 209. This bit includes a compensation and lubrication system which is of the same type shown in FIGS. 3 and 6. Here, passages 213 in each section of the bit body lead to a ball plug 215 which is welded at 217 to retain a series of ball bearings 219 in mating raceways formed between the bearing shaft 221 and the cutters 175, 177 and 179.

The bearing shaft axis 223 is obliquely oriented to the central or rotational axis 225 of the bit as indicated by the angle gamma. The angle gamma is referred to as the pin angle. The bearing configuration shown in FIG. 16 also includes a pilot pin 227 and a journal bearing 229 which includes a wear resistant inlay 231 and an O-ring groove or surface 233 that opposes O-ring 235, which also opposes a groove 237 in one of the cones 175, 177 or 179.

Figure 17:
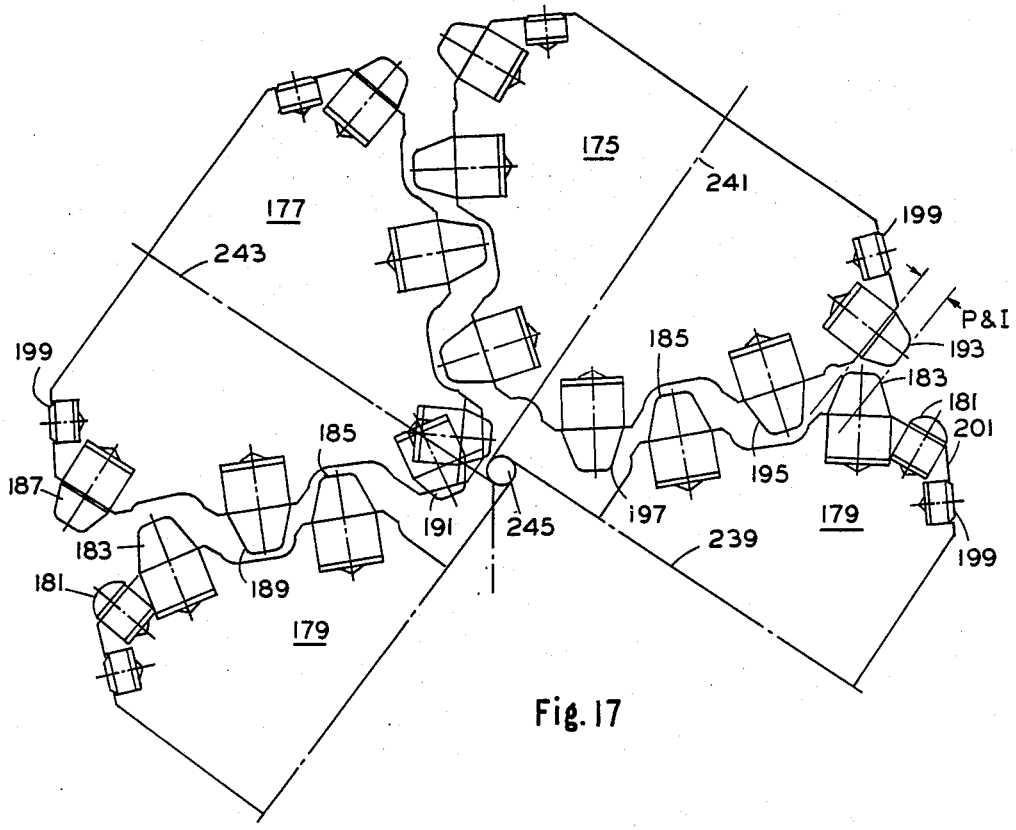
FIG. 17 is a design layout of the cones of the bit of FIG. 14 to show the relationship between the cones and the circumferential rows of inserts.

FIG. 17 is a design layout of the cones of the bit of FIG. 14 to show the relationship between the cones and the circumferential rows of inserts. The various inserts have the same numeral designations as in FIGS. 14 and 16 and show that the various rotational axes 239, 241 and 243 do not intersect at a point. That is, the rotational axes of the cones intersect or are tangent to a circle 245 known as the "offset circle." This causes some skidding of the cones on the borehole bottom to enhance drilling in the softer formations.

Each of the inserts is secured by interference fit in mating, drilled holes in the cones. One way to describe the relationships of the various inserts and the cutters is with reference to a first cone 175 having inner rows of circumferential inserts 195, 197 and a heel row 193. A second cone 179 has an inner circumferential row 185 and no heel row but rather, a circumferential row of reaming inserts 181 that are recessed and smaller in diameter than those of the heel rows of cones 177 and 175. Cone 179 also has an adjacent or hell-catching row 183 that operates in a transition zone between the heel rows and the remainder of the inner rows. A third cone 177 has inner rows of circumferential inserts 189, 191 and a heel row 187. Each of the cutters has a row of circumferential gage inserts 199 to help maintain the full and selected diameter of the hole. The bit of FIG. 14 has a nozzle arrangement such that the jet stream has a high velocity core that strikes the bottom of borehole while the low velocity outer region or skirt strikes the inserts of the heel and first inner rows to help clean them of cuttings lodged between adjacent inserts.

In FIG. 17 the inserts 183 of the hell-catching row have ends that intermesh a distance I into the narrow groove between the inserts 193, 195 of cone 175. This intermesh is substantially equal to the amount of projection P of the end of insert 193 from the surface of cone 175.

Figure 15:
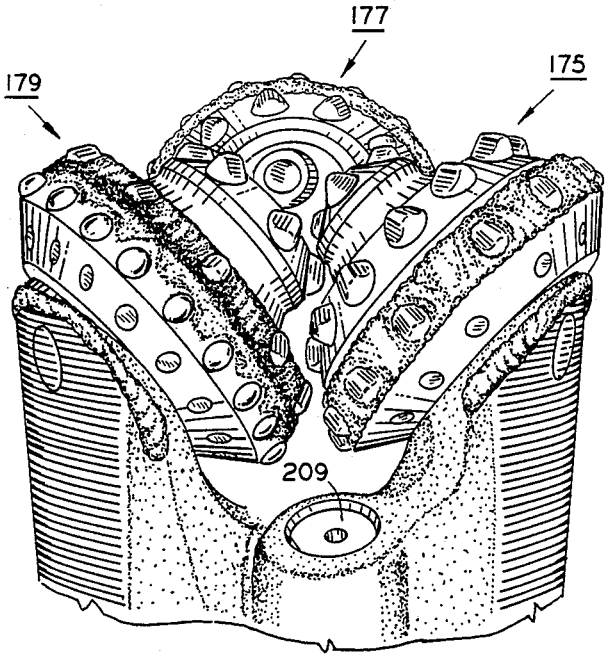
FIG. 15 is a perspective view of the bit FIG. 14 after drilling a soft formation.

In operation of the drill bit shown in FIG. 14, the bit is attached to a drill string (not shown) that is raised and lowered, as well as rotated, by a drill rig (not shown) at the surface of the earth. Weight is applied to the bit during rotation and such that the cutters 175, 177 and 179 rotate and cause the inserts to engage and disintegrate the bottom of the borehole. Each circumferential row of inserts engages a designated annular pattern on the bottom of the hole, except the reaming insert 181. The reaming insert 181 serves two primary purposes: (1) The breakdown of ribs or rock build-up that tend to form at the corner of the borehole and along the lower portion of the wall of the hole and (2) stabilization of the bit against lateral movement. The use of the small reaming insert has a special advantage of making the reaming row 181 and the hell-catching row 183 independent of each other to enable close spacing in the hell-catching row which increases its durability, resistance to wear and breakage, and enhances penetration rate. Also, the use of a small reaming insert 181 results in added resistance to balling, which occurs frequently in the prior art bits with a full size heel row and a staggered adjacent inner row. Testing has shown that balling is more likely to occur on circumferential rows of inserts in a close, staggered arrangement without any room for the lateral displacement of cuttings. The short and small diameter reaming inserts 181 of the bit of FIG. 14 do not contact the borehole bottom and therefore generate only a very small amount of cuttings which do not contribute significantly to balling as illustrated in FIG. 15. Thus, the bit of FIG. 14 has no inserts that are in staggered closely spaced circumferential rows. Hence, there is a maximum resistance to balling.

Another feature of the bit shown in FIG. 14 is the pin angle gamma which is increased from about 33 degrees to about 36 degrees. This has the effect of bringing the bases of the cones in the vicinity of the heel row closer together such that the inserts of each row interfit or intermesh between the inserts of adjacent rows all the way from the innermost inner row to the heel rows, including the hell-catching row 183 in the groove formed between the rows 193 and 195 of cone 175.

One significant advantage of the invention is the reduction of balling when drilling shale or other soft formations. The use of intermesh of inserts in all circumferential grooves between rows is a key to reduced balling. Here, intermesh is achieved even between the hell-catching row and the narrow groove of the adjacent cone. The intermesh here is greater than the marginal amount found in the prior art bits and is sufficient to minimize balling in the narrow groove. An effective amount of intermesh of the hell-catching row into the narrow groove is not less than 50 percent of the projection of the inserts of the associated heel row for common bit types and drilling practices. Ideally, intermesh is equal to substantially the full projection of the associated heel row.

Once an effective amount of intermesh is provided, additional improvement is achieved by proper location of the jet nozzles to break up the filter cake on bottom with a high velocity jet core which misses the cones and striking and cleaning the inserts with the lower velocity skirt.

Even with full intermesh and proper jet placement, the cone with the hell-catching row in close, staggered arrangement with the adjacent heel row is still the most likely to ball up. The invention therefore provides for a row of small diameter reaming inserts in place of the conventional heel inserts. The reaming inserts engage the borehole wall to stabilize the bit and ream excessive rock build-up left by the conventional heel rows on the other cones. They therefore only generate a very small amount of material, thus reducing the tendency of that row to ball up. In addition, the recessed reaming row will allow lateral displacement of the material generated between the inserts of the hell-catching row, further reducing balling tendencies in this critical row.

While the invention has been shown in only two of its forms, it should be apparent to those skilled in the art that it is not thus limited, but is susceptible to various changes and modifications without departing from the spirit thereof.

I claim:

1. An earth boring bit with a body adapted for attachment to a drill string:

three cantilevered bearing shafts extending downwardly and inwardly, each at a selected pin angle relative to the rotational axis of the bit;

a cone rotatably secured to each bearing shaft and having circumferential rows of earth disintergrating teeth of wear resistant inserts with ends having a selected projection from the surface of the cone;

a first cone having a heel row and an inner row separated from the heel row by a narrow circumferential groove that tends to ball with cuttings during drilling;

a second cone having a hell-catching row that extends into the narrow groove with an intermesh in an amount effective to minimize balling in the narrow groove.

2. The invention defined by claim 1 wherein the amount of intermesh of the hell-catching row into the narrow groove is not less than 50 percent of the projection of the inserts of the associated heel row.

3. The invention defined by claim 1 wherein the amount of intermesh of the hell-catching row into the narrow groove is equal to substantially the full projection of the inserts of the associated heel row.

4. The invention defined by claim 1 which further comprises:

a nozzle in the body to direct a jet stream of fluid having a high velocity core and a lower velocity diverging skirt between the first and second cones such that the core of the jet stream misses the cones but the diverging skirt strikes the hell-catching row of the second cone and the heel row of the first cone.

5. An earth boring bit with rotatable cones and a body adapted for attachment to a drill string:

three cantilevered bearing shafts extending downwardly and inwardly, each at a selected pin angle relative to the rotational axis of the bit;

the pin angle of each of the bearing shafts, the geometry of the cones and the sizes of the inserts selected to provide intermesh of each inner row of inserts with at least one circumferential groove on an opposing cone to minimize balling of cuttings in the grooves during drilling;

a first cone having a heel row and an inner row separated from the heel row by a narrow circumferential groove that tends to ball with cuttings during drilling;

a second cone with an inner circumferential row of inserts but not a heel row, and instead, a circumferential row of reaming inserts smaller in diameter than those of the heel row of the first cone to engage the wall but not the bottom of the borehole to stabilize the bit and maintain the intended diameter of the borehole;

the second cone having a hell-catching row that extends into the narrow groove with an intermesh in an amount effective to minimize balling in the narrow groove.

6. The invention defined by claim 5 wherein the amount of intermesh of the hell-catching row into the narrow groove is not less than 50 percent of the projection of the inserts of the associated heel row.

7. The invention defined by claim 5 wherein the amount of intermesh of the hell-catching row into the narrow groove is equal to substantially the full projection of the inserts of the associated heel row.

8. An earth boring bit with a body adapted for attachment to a drill string:

three cantilevered bearing shafts extending downwardly and inwardly, each at a selected pin angle relative to the rotational axis of the bit;

the pin angle of each of the bearing shafts, the geometry of the cones and the sizes of the inserts selected to provide intermesh of each inner row of inserts with at least one circumferential groove on an opposing cone to minimize balling of cuttings in the grooves during drilling;

a first cone having a heel row and an inner row separated from the heel row by a narrow circumferential groove that tends to ball with cuttings during drilling;

a second cone having a hell-catching row that extends into the narrow groove with an intermesh in an amount effective to minimize balling in the narrow groove.

three nozzles in the body to discharge during drilling jet streams of fluid having high velocity cores and a lower velocity diverging skirts between the cones, at least one nozzle located in the body between the first and second cones such that the core of the jet stream misses the cones but the diverging skirt strikes the hell-catching row of the second cone and the heel row of the first cone.

9. The invention defined by claim 8 wherein the amount of intermesh of the hell-catching row into the narrow groove is not less than 50 percent of the projection of the inserts of the associated heel row.

10. The invention defined by claim 8 wherein the amount of intermesh of the hell-catching row into the narrow groove is equal to substantially the full projection of the inserts of the associated heel row.

* * * * *

UNITED STATES PATENT AND TRADEMARK OFFICE

CERTIFICATE OF CORRECTION

PATENT NO. : 4,984,643

DATED : Jan. 15, 1991

INVENTOR(S) : Isbell et al.

It is certified that error appears in the above-identified patent and that said Letters Patent is hereby corrected as shown below:

On the title page:
In the next to the last line in the abstract, change "heel" to -- hell --

In column 2, line 3, change "delected" to -- deleted --

Signed and Sealed this

Eighth Day of September, 1992

*Attest:*

DOUGLAS B. COMER

*Attesting Officer*

*Acting Commissioner of Patents and Trademarks*